US007425972B2

(12) United States Patent
Updegraff et al.

(10) Patent No.: US 7,425,972 B2
(45) Date of Patent: Sep. 16, 2008

(54) METHOD AND SYSTEM FOR IMPROVED CONTROL OF XEROGRAPHIC PARAMETERS IN A HIGH QUALITY DOCUMENT SYSTEM

(75) Inventors: Shawn P. Updegraff, Fairport, NY (US); Eric M. Gross, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 171 days.

(21) Appl. No.: 11/280,796

(22) Filed: Nov. 16, 2005

(65) Prior Publication Data

US 2007/0109394 A1 May 17, 2007

(51) Int. Cl.
*B41J 2/44* (2006.01)

(52) U.S. Cl. ..... 347/132; 347/247

(58) Field of Classification Search ..... 347/132, 347/237, 238, 247
See application file for complete search history.

(56) References Cited

U.S. PATENT DOCUMENTS 5,606,395 A * 2/1997 Yang et al. ..... 399/81
5,729,626 A * 3/1998 Hada et al. ..... 382/170
6,006,010 A * 12/1999 Hada et al. ..... 358/1.7
6,078,687 A * 6/2000 Venkateswar ..... 382/169
6,078,697 A * 6/2000 Ng ..... 382/275
6,522,791 B2 * 2/2003 Nagarajan ..... 382/321
6,625,312 B1 * 9/2003 Nagarajan et al. ..... 382/176
2004/0135878 A1 7/2004 Mizes et al.
2004/0252905 A1 12/2004 Mizes et al.
2004/0257619 A1 12/2004 Loce et al.
2005/0036705 A1 2/2005 Viassolo et al.
2005/0099446 A1 5/2005 Mizes et al.
2005/0123193 A1 * 6/2005 Lamberg et al. ..... 382/167
2005/0134623 A1 6/2005 Mizes
2005/0134624 A1 6/2005 Mizes
2005/0196187 A1 9/2005 Mizes et al.
2006/0067575 A1 * 3/2006 Yamada ..... 382/176

* cited by examiner

*Primary Examiner*—Huan H Tran
(74) *Attorney, Agent, or Firm*—Michael J. Nickerson; Basch & Nickerson LLP

(57) ABSTRACT

A system changes the setpoint of a digital reprographic system in response to the local image content by utilizing tag data that contains information identifying the image content type of a corresponding image data pixel. The system modifies the reproduction characteristics of the output to accommodate the diverse image content types by simultaneously controlling the overall tone reproduction curve of the system on a pixel-by-pixel basis.

16 Claims, 8 Drawing Sheets

METHOD AND SYSTEM FOR IMPROVED CONTROL OF XEROGRAPHIC PARAMETERS IN A HIGH QUALITY DOCUMENT SYSTEM

BACKGROUND AND SUMMARY

Digital reprographic systems are now in common usage and have begun to challenge traditional offset printing for color reprographic applications. For these systems, the visible quality, or print quality, of the output must be held at a high level. This usually requires application of feedback control systems to the various subsystems that make up the reprographic engine to maintain uniform quality. Recent systems have increased image processing capabilities in the digital image path so as to help modify the image processing parameters of an image, even on an individual pixel basis, to increase the range of control available.

These systems with increased image processing capabilities have enabled consistent high quality output from high speed reprographic machines. However, a xerographic subsystem is often the most variable element in the overall reprographic process.

While conventional process controls have improved the variability of the xerographic process, there is a limit to the amount of variability that process controls can reduce. Recent effort has focused on transferring some of the xerographic variability control to the imaging system. In such implementations, systematic variability in the xerographic subsystem is compensated for by modifying the digital image prior to printing.

Conventional systems usually maintain the xerographic system at some standard setpoint. This is a condition where all of the relevant xerographic parameters are set to some standard set of values. However, the establishment of the standard set of values is an easy task.

For example, there may be several different ways of modulating an exposure beam so as to halftone a contone part of an image. In this example, the resulting xerographic standard set of values may have to compromise between that which is ideal for text and line art versus that which is ideal for high frequency halftones used for contone parts of the page image.

Therefore, it would be desirable to provide a method for modifying the xerographic standard set of values to match the characteristics of the portion of the image being exposed at any time. Moreover, it would be desirable to provide a method for modifying the xerographic standard set of values that would not be susceptible to the underlying physics of the xerographic process, a slow response of the system to changes. Also, it would be desirable to provide a method for modifying the xerographic standard set of values whose response is rapid enough to accommodate the changes necessary. Lastly, it would be desirable to provide a method for modifying the exposure intensity of the xerographic system so as to allow for modifications to the underlying xerographic process on a pixel by pixel basis.

BRIEF DESCRIPTION OF THE DRAWING

The present invention may take form in various components and arrangements of components, and in various steps and arrangements of steps. The drawings are only for purposes of illustrating a preferred embodiment and are not to be construed as limiting the present invention, wherein.

DETAILED DESCRIPTION

Figure 1:
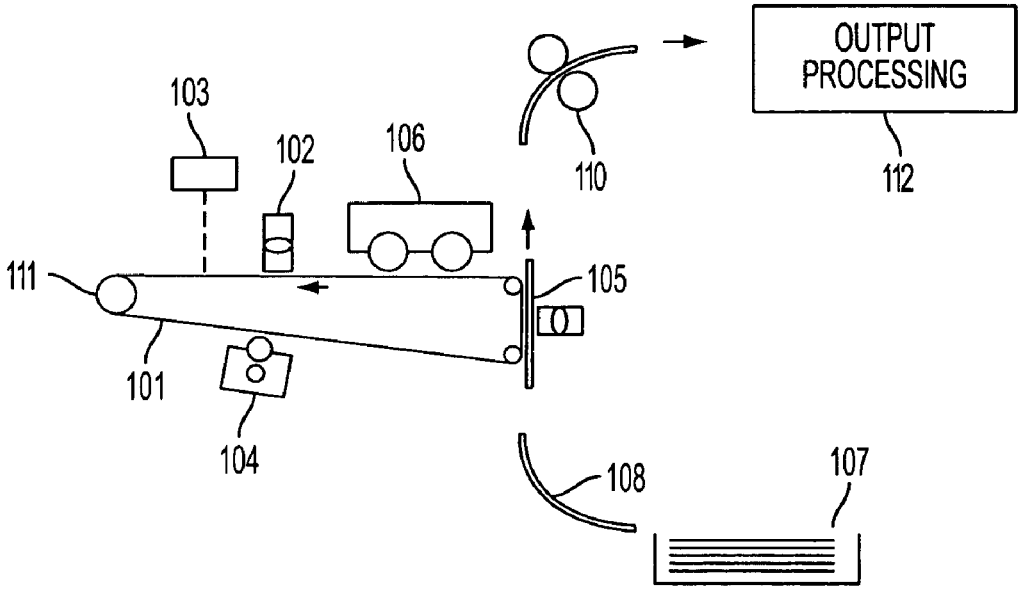
FIG. 1 PRIOR ART
FIG. 1 shows a schematic view of a typical xerographic reproduction engine.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

FIG. 1 provides a schematic of the operation of a typical xerographic printing engine. As illustrated in FIG. 1, a key component is a photoreceptor belt 101, which is covered with a photosensitive insulating material. The photoreceptor belt 101 is driven in by a motor 111 in a counterclockwise direction. As the photoreceptor belt 101 passes through a charging station 102, the photoreceptor belt 101 is charged with by a corona discharge device.

The continued motion of the photoreceptor belt 101 takes the photoreceptor belt 101 past an exposure region 103, where it is exposed to light of sufficient energy and intensity to discharge the belt due to photoelectric discharge wherever the light hits the belt. The light can come from an illumination and lens system imaging a physical original, or it may come from a laser device driven by an electronic system to produce the desired image.

The continued motion of the photoreceptor belt 101 takes the photoreceptor belt 101 past a development station 104, where the remaining charged regions attract charged toner particles to the photoreceptor belt 101. At a transfer station 105, the toner particles are transferred to a piece of media. The residual toner on the photoreceptor belt 101 is removed in a cleaning station 106.

In conjunction with the photoreceptor belt 101, there is a media transport system or paper path that is synchronized to the motion of the photoreceptor belt 101. Sheets of the media are taken from a tray 107 and positioned at a pre-transfer station 108. From the pre-transfer station 108, the media is moved through the transfer system 105 where various charging devices are used to electrostatically transfer the toner from the belt to the media. After the transfer station 105, the media with the attached toner is passed through a fuser 110, where the toner is fused, by heat, to the paper. After the fuser 110, the media is passed into an output processing module 111.

While the preceding description of a xerographic engine gives the overall sequence of events that occur during a xerographic copy or print cycle, it does not include any detailed explanation of the process controls that are necessary to maintain the proper operation of the engine. The details of these process controls are well known to those skilled in the art.

Typically, these process controls adjust the various charging voltages, as well as, the mixing conditions of the toner to ensure that the xerographic process is maintained at a desirable condition. These process controls usually compensate for conditions like the aging of the toner or photoreceptor and changes in the environment like temperature and humidity. However, there are other parameters that affect the xerographic process setpoint as well, in particular, the output power of the laser.

The setpoints of the xerographic process depend on the intensity of the exposure device, hereafter assumed to be a laser system. The intensity of the laser is set to some predetermined value that guarantees that the typical types of graphic elements are well developed. These graphic elements can include lines and solid areas typical of text and line art elements. These graphic elements can also include halftone dots that are typical of contone images. The settings are more complex for color systems, since most colors are made by mixing one or more subtractive toners (Cyan, Magenta, Yellow, and/or Black) to create the desired color. Because one or more of the component toners is often at less than full density, even solid areas of color require halftone rendering.

Each type of graphic element poses slightly different requirements on the xerographic setpoint. Halftones, which are made up of many small dots use a more "aggressive" setup; that is one where even small exposure profiles result in consistent development. On the other hand, such an aggressive setup can result in broadening of line features, thereby reducing the visual quality or sharpness of text. Thus, conventional xerographic systems have been constrained to choose a setpoint that is a compromise between the two states.

One option that has been implemented in some machines is to alter the setpoint with respect to the laser intensity on a page-by-page basis. This can be done either automatically or manually by the user. In this case, each page can have a xerographic setup that best reproduces the kind of content that it contains. However, this method has a drawback in that this method does not handle pages with mixed content any better than a single setpoint system does. Unfortunately, since most pages have mixed content, where some regions of the page contain text and other graphic elements that are halftoned, the per-page setpoint system is still not optimized.

Therefore, a setpoint having a basis that is something less than a page basis is needed to meet the requirements of mixed content pages. More specifically, a setpoint having a pixel basis is needed to meet the requirements of mixed content pages.

To realize a setpoint having a pixel basis, individual elements of the page must be identified and tagged with information that reveals the content of regions of the page. This tagged information can be used to establish setpoints on a region by region basis or pixel by pixel basis. As noted above, the setpoint most amendable to a region by region basis or pixel by pixel basis change is the changing of laser intensity on a region by region basis or pixel by pixel basis.

In other words, using tagged information to establish setpoints, as described above, allows a xerographic system to establish a setup change at the maximum resolution of the system. This is possible, because changing the intensity of the laser can be done very quickly, in times on the order of tens of nanoseconds, much shorter than the response of other parameters of the xerographic setup.

By changing the intensity of the laser, the change in image content is compensated for and the non-uniformities in the xerographic system that are not amenable to correction by other means are corrected. For example, it is often the case that the photoreceptor is not uniform in the photoreceptor's response to exposure, with variation from side to side. The changing of the intensity of the laser can be programmed to correct for such non-uniformity as well as for the image content correction.

Figure 2:
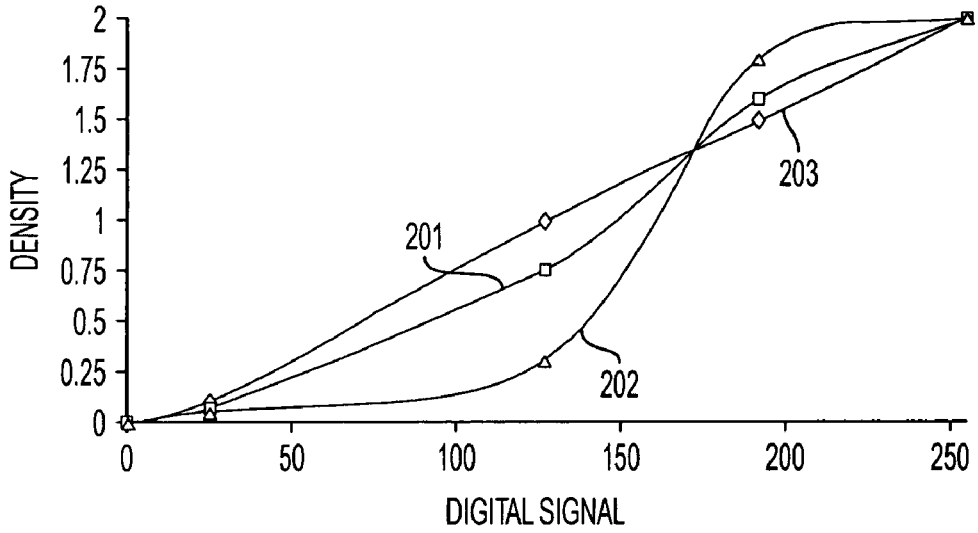
FIG. 2 PRIOR ART
FIG. 2 shows the tone reproduction curves for a typical reprographic system.

One of the desirable characteristics of a digital reprographic system is the ability to define and control the tone reproduction curve of the system. The tone reproduction curve defines the output density as a function of the input data value. FIG. 2 illustrates an example of a plot of output density as a function of a data signal value.

As illustrated in FIG. 2, curve 201, is typical of the "raw" or uncorrected response of a xerographic system. As the digital data signal varies in value from 0 to 255, the output density varies from 0 (corresponding to blank output media) to 2.0 which is a density value typical of xerographic or offset printing systems when the output media is fully covered by the marking media. Notice that in the mid-tone range, the curve is rather steep. While density can be used as the measure of the output marking, there are alternative measures that may be used. For example, when the marking material is colored, the measure is more often $\Delta E$, where $\Delta E$ is the CIE-color difference between the blank media and the marked region.

The desired shape of the tone reproduction curve is dependent on the characteristics of the image content. For example, as illustrated in FIG. 2, text and line art is often reproduced with a tone reproduction curve that is steeper, as shown by curve 202, while contone images, as illustrated in FIG. 2, are often reproduced with a tone reproduction curve that is more gently sloping, as shown by curve 203. Therefore, it is desirable that the system allow for the control of the tone reproduction curve, and that it be capable of changing the tone reproduction curve to correspond to the local image content.

Figure 3:
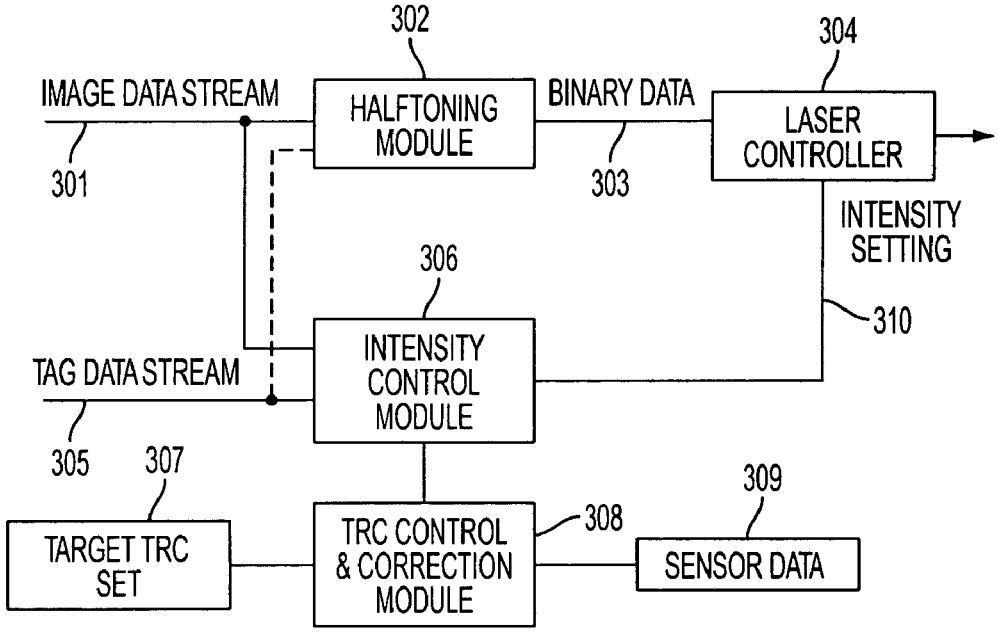
FIG. 3 shows a block diagram of an implementation of an intensity control system.

FIG. 3 shows, in schematic form, an architecture for implementing the controls described above. The image signal stream 301 is input to a halftoning module 302 which generates a binary signal stream 303 that is output to the laser controller 304 to generate a series of ON and OFF signals to the laser. The halftoning process used by the halftoning module 302 may be any of the various conventional halftoning schemes. Thus, the actual halftoning process used is a choice of the designer of the image processing path. The halftoning module 302 can also accept the tag data from the tag data stream 305 which allows the halftoning module 302 to switch halftoning algorithms in response to the image content of the corresponding image pixel.

FIG. 3 also shows tone reproduction curve control and correction module 308 that can generate one or more sets of laser intensity setting data in response to a combination of a target tone reproduction curve set 307 and a signal from sensors 309 that are monitoring the current response of the xerographic system. It is noted that target tone reproduction curve set 307 is one per image content type.

The output of the tone reproduction curve control and correction module 308 is a set of laser intensity setting data that that will be used in reproducing the image data in a human readable or displayable form. An intensity control module 306 receives the laser intensity setting data from the tone reproduction curve control and correction module 308. The intensity control module 306 also receives information from both the image data stream 301 and the tag data stream 302. The intensity control module 306 uses a set of lookup tables to generate laser intensity signal 310 that controls the peak intensity of the laser beam. The laser intensity signal 310 controls the intensity of the laser beam when the binary data 303 is a "1."

It is noted that although the intensity control module 306 has been described as using lookup tables, it is possible to achieve the same results by performing computations in a real time basis.

Figure 4:
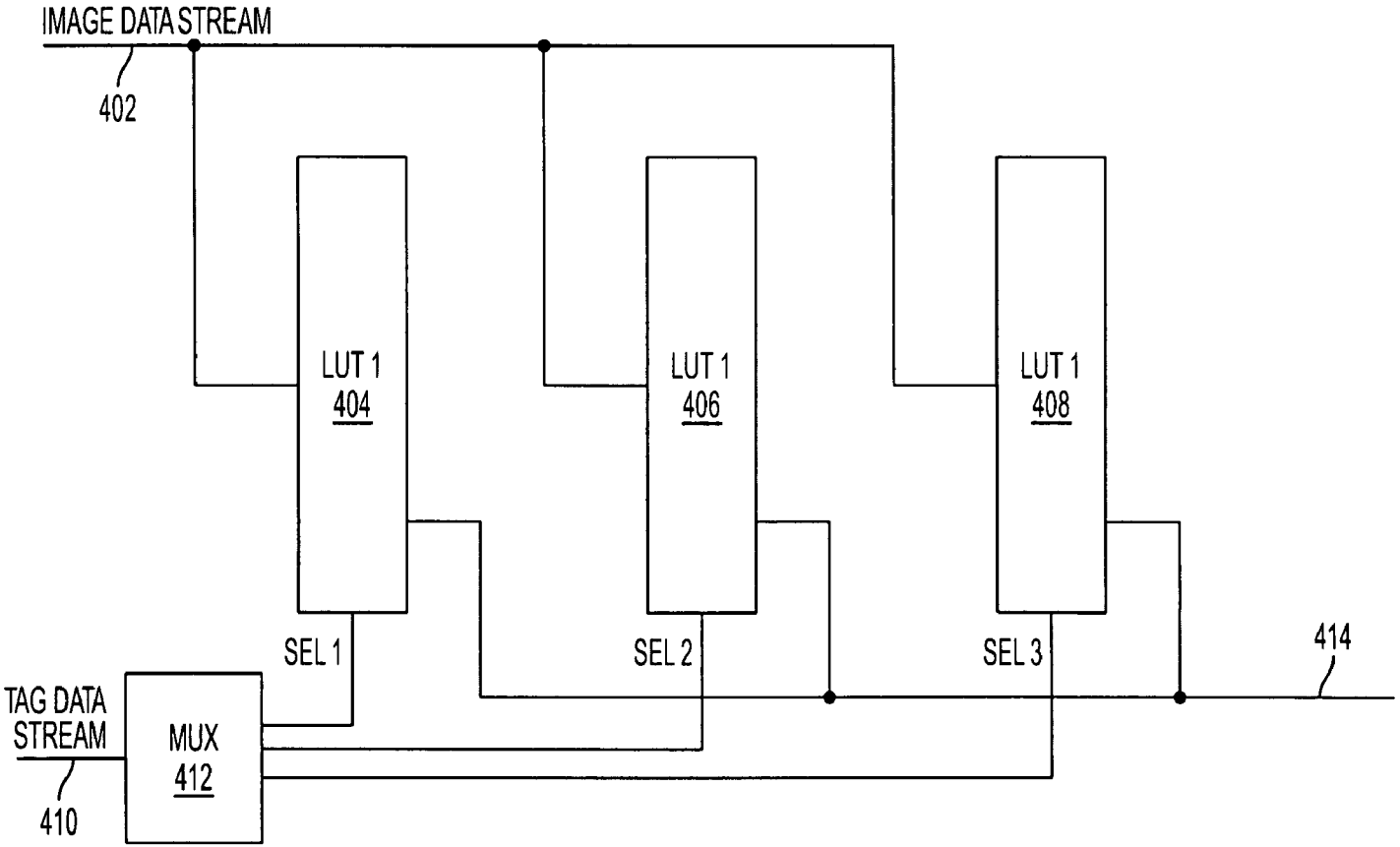
FIG. 4 shows a version of the system in FIG. 3 that uses lookup tables.

FIG. 4 illustrates an example of an implementation of the intensity control module 306 using lookup tables. As illustrated in FIG. 4, the example is based upon three different image content types. It is noted that more than three different image content types or only two different image content types could be utilized. Each image content type has a corresponding lookup table. For example, lookup table 404 corresponds to 170 dots per inch text, lookup table 406 corresponds to stochastic screened images, and lookup table 408 corresponds to 212 lines per inch photorealistic image content.

The image data stream 402 is applied as the input to each lookup table (404, 406, and 408). The tag data stream 410 is input to a multiplexer 412 that activates one of its three outputs corresponding to the image content type identified by the tag data. These outputs are applied to the enable control of the appropriate one of the three lookup tables (404, 406, and 408), so that the output from the appropriate table is sent to the laser controller 304.

Figure 5:
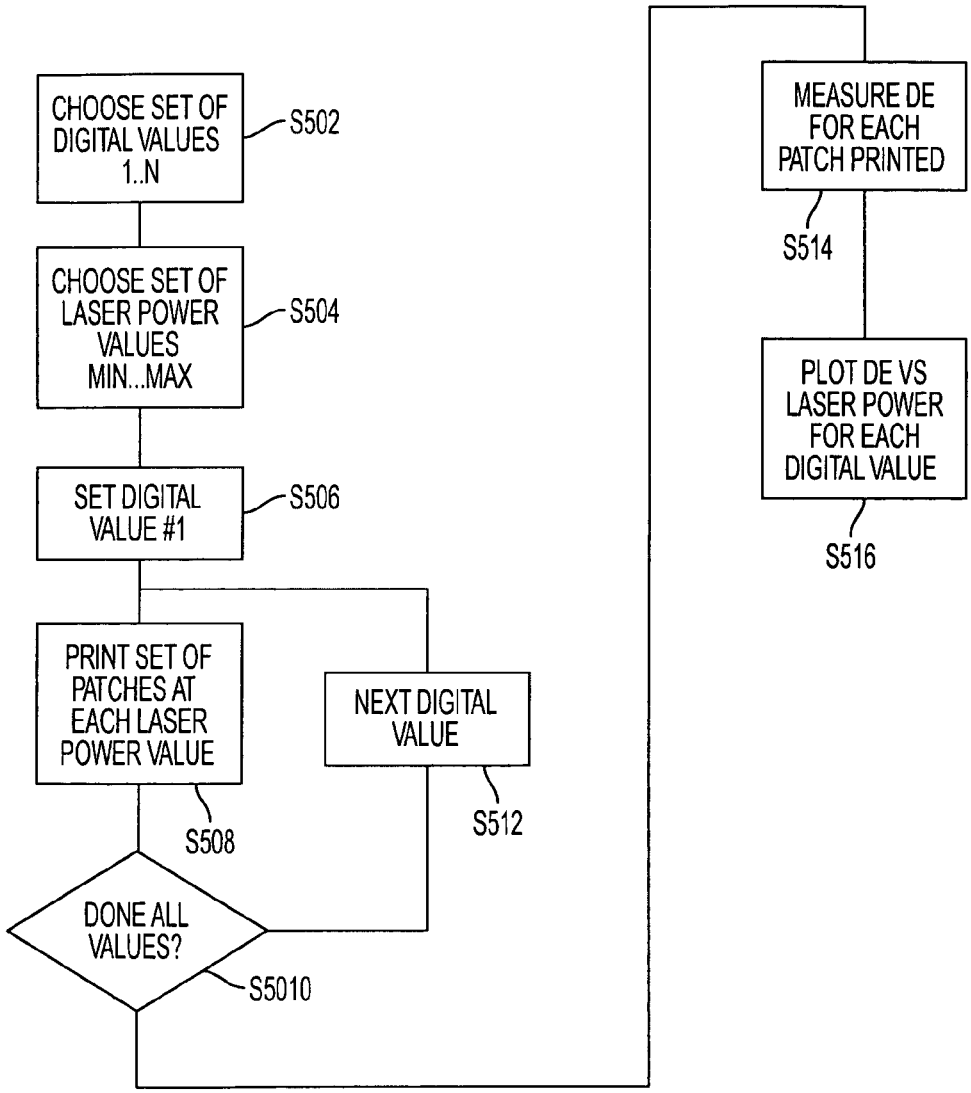
FIG. 5 shows a flow diagram for determining the content of the control lookup tables.

FIG. 5 shows one method by which the contents of each table are generated. In this method, a set of values of the digital input signal, covering the range from 0 to 255, is selected at step S502. A set of laser power values covering the range of available powers is chosen at step S504. Starting with the first chosen digital value S506, at step S508, a set of patches is printed wherein each patch has the chosen digital value for the data but a different value of laser power.

At step S5010, it is determined whether all the digital values have been printed. If it is determined at step S5010 that all the digital values have not been printed, the next digital value is retrieved, and step S508 is repeated.

If it is determined at step S5010 that all the digital values have been printed, at step S514 the density is measured for each patch (or if colored marking media is used, CIE-ΔE is determined for each patch). A plot of these density or ΔE values as a function of laser power is developed at step S516.

Figure 6:
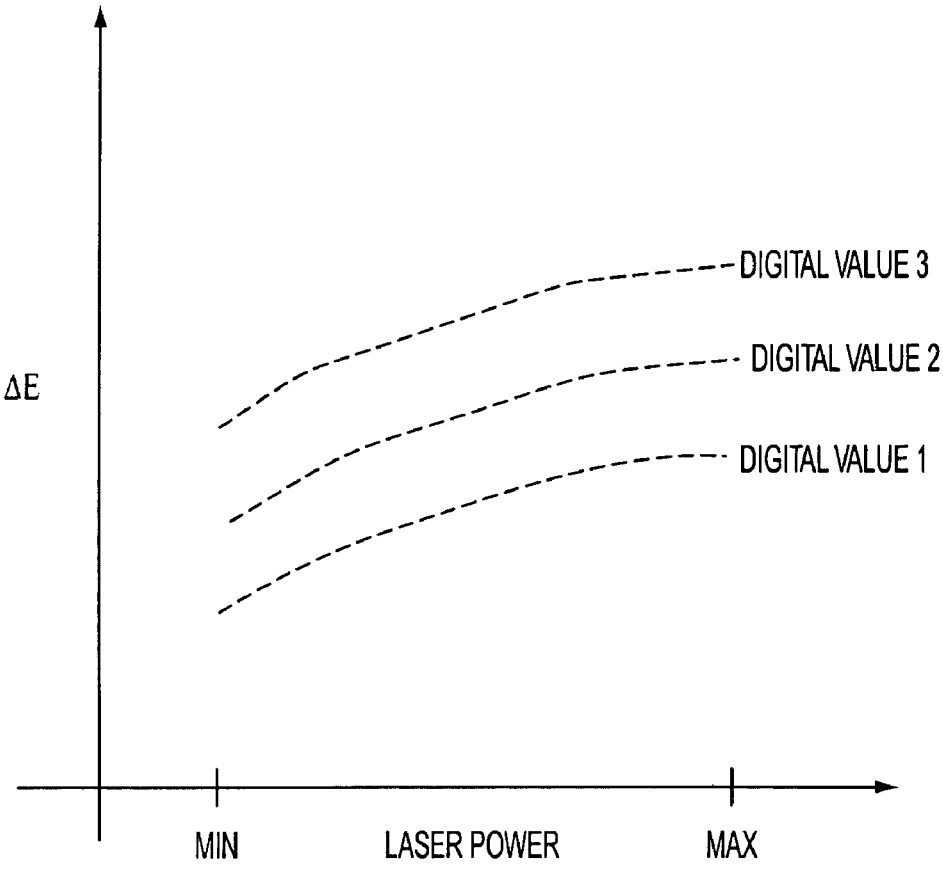
FIG. 6 shows output of a calibration process.

FIG. 6 shows an example plot of density or ΔE values as a function of laser power. In FIG. 6, curves for three different digital values are illustrated. In this example, it is assumed that the digital values are such that digital value 3 is greater than digital value 2 which in turn is greater than digital value 1.

The set of data generated by this process can be used to generate the tables that will produce any desired tone reproduction curve. For any given tone reproduction curve, the data obtained using the process outlined in FIG. 5 can be used to generate a set of laser power values for each digital image value. For example, using the curve set in FIG. 6, for digital value 1, the laser power needed for a given ΔE output can be readily determined.

Figure 7:
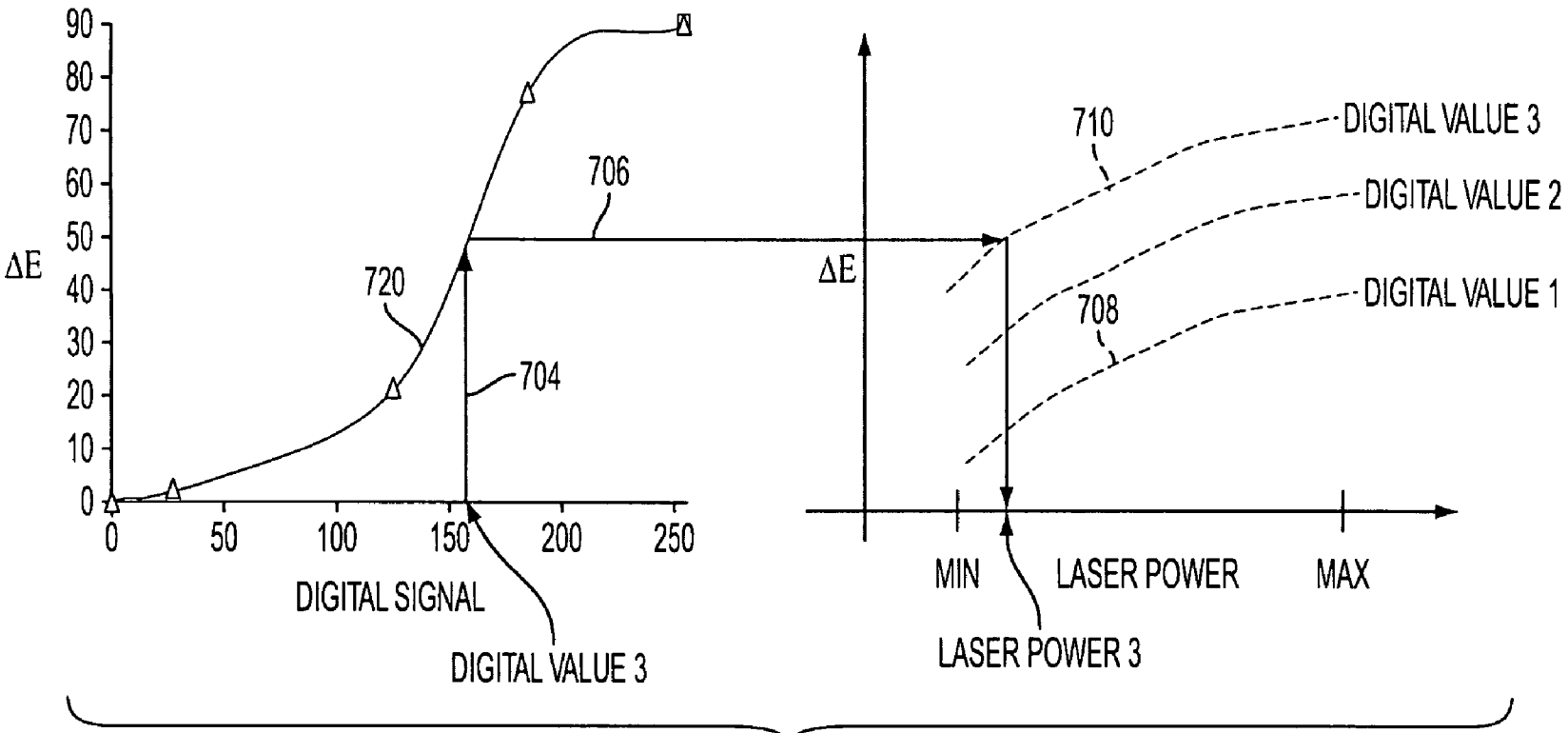
FIG. 7 shows the calibration data being used to generate the data for a lookup table for a given tone reproduction curve.

FIG. 7 shows how the calibration data can be combined with a target tone reproduction curve to generate the data needed for a lookup table. In FIG. 7, one of the tone reproduction curves from FIG. 2 is replotted and related to the calibration graph of FIG. 6.

As illustrated in FIG. 7, for the digital input value 3, a line 704 can be drawn to the target tone reproduction curve 720. Using the ΔE value, a "reverse" conversion 706 is done so that the ΔE value is mapped to the curve 710 that was obtained from the calibration process. The ΔE value of tone reproduction curve 720 is extended to the ΔE value of curve 710 by the "reverse" conversion 706 so that the ΔE value of tone reproduction curve 720 is mapped to curve 710 representing the corresponding digital value of tone reproduction curve 720. The x-coordinate of the intersection of the ΔE value of curve 710 is the desired laser power for that combination of tone reproduction curve and digital input. This process can be repeated for as many combinations of digital value and tone reproduction curve to generate the desired number of values or lookup tables.

It will be understood by those skilled in the art, that it may not be necessary to generate a table for every value of digital input. In many cases, a coarser table will suffice, in which case a smaller table is used by truncating one or more of the low order bits of the digital input signal that are used as the input to the address of the entry in the lookup table. Thus, it may prove sufficient to have a table with only 64 or even 32 entries instead of the full 256 implied by 8-bit digital data values. The process shown in FIG. 7 and described above is computationally simple and can be done by a microprocessor unit embedded in the tone reproduction curve control and correction module 308 of FIG. 3.

If needed, this lookup process can be implemented in a dynamic fashion. For example, if the sensors monitoring the system indicate that the system response has changed, meaning that the tone reproduction curve has changed, the process of generating a new set of lookup table entries can be quickly regenerated and loaded into the tone reproduction curve control and correction module 308 of FIG. 3.

Figure 8:
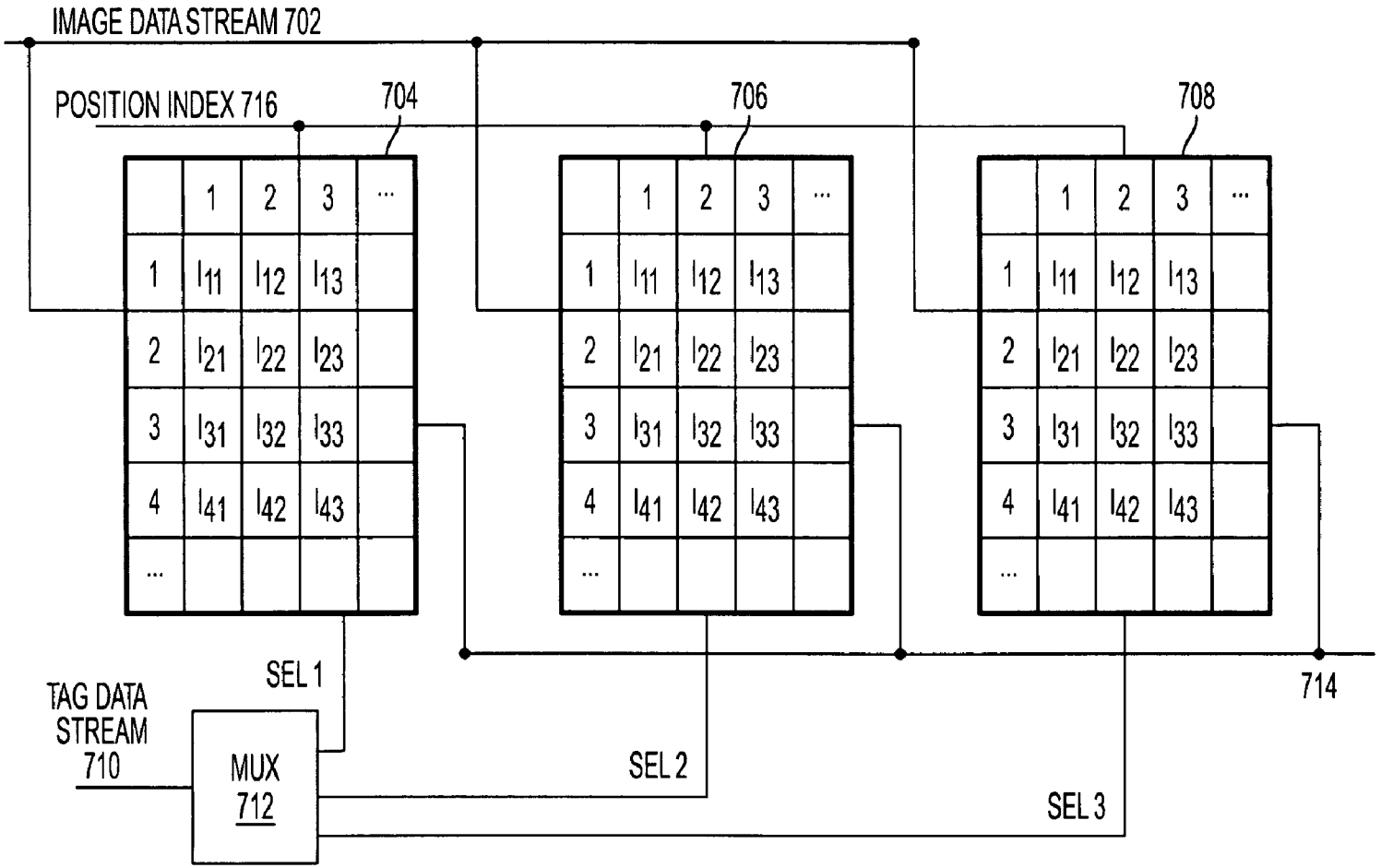
FIG. 8 shows another implementation using two-dimensional lookup tables that allows for positional dependent corrections.

FIG. 8 illustrates an example of an implementation of the intensity control module 306 using lookup tables wherein spatial tone reproduction curve control (uniformity) is realized. As illustrated in FIG. 8, the example is based upon three different image content types. It is noted that more than three different image content types or only two different image content types could be utilized. Each image content type has a corresponding lookup table. For example, lookup table 704 corresponds to 170 dots per inch text, lookup table 706 corresponds to stochastic screened images, and lookup table 708 corresponds to 212 lines per inch photorealistic image content.

The image data stream 702 is applied as the input to each lookup table (704, 706, and 708). In addition to the data stream, pixel position information stream 716 is applied as the input to each lookup table (704, 706, and 708). The contone level from the image data stream 702 and the pixel position parameter from the pixel position information stream 716 are supplied as indices to the two-dimensional lookup tables (704, 706, and 708).

The tag data stream 710 is input to a multiplexer 712 that activates one of its three outputs corresponding to the image content type identified by the tag data. These outputs are applied to the enable control of the appropriate one of the three lookup tables (704, 706, and 708), so that the output from the appropriate table is sent to the laser controller 304.

In operations, the system realizes variable image rendering by modulating the imager intensity on a pixel-by-pixel basis using tag information. More specifically, the intensity is varied based on image content including, but not limited to: contone level, halftone screen design, whether the object is text or line art, and/or the pixel's position.

The tag information allows for a unique intensity "mapping" for each contone level and rendering object type. It is noted that the number of "setups" or rendering objects supported can be expanded by expanding the tags; e.g., a thick lines vs. thin lines tag.

The contone data and halftone tag data are used by a halftone rendering module and analyzed simultaneously by an intensity control module. The intensity control module maps the contone level and tag information for each pixel to intensity.

As noted above, a single lookup table can be used for each rendering object type; e.g., halftone designs (angle, frequency, etc), text/line art. The lookup table can be one-dimensional for mean tone reproduction curve control or two-dimensional for spatial tone reproduction curve control (uniformity). The incoming tag data determines which lookup table is used, while the contone data is used as the lookup table index. In the case of spatial tone reproduction curve control, both contone level and a pixel position parameter would be supplied as indices to the two-dimensional lookup table.

It is noted that fewer than all contone levels can provide adequate tone reproduction curve control. However some form of interpolation between contone levels will be employed for lookup tables containing less than the maximum number of contone Levels.

An alternate approach to lookup tables is to use a parameterized functional form and only update the parameters as needed.

It is noted that the lookup tables or function parameters in the intensity control module could be updated using a control algorithm designed to meet the temporal stability and uniformity requirements of the xerographic system. It is further noted that although it is possible to create intensity mappings in an open loop system (calibration), the stability of most xerographic systems require a closed loop process to be used.

In the calibration process a sensor is used for feedback. For example, a single point sensor, such as an ETAC or a spatial sensor such as a full width array, could be utilized. In this calibration process, a set of test patches of each rendering type is read by the sensor. For tone reproduction curve control, it would be necessary to schedule multiple contone levels of each screen type in order to measure the tone reproduction curve shape.

It is noted that the number of contone levels multiplied by the number of rendering types quickly leads to an impractical number of sample patches to be scheduled and processed. Thus, the control algorithm and parameters could be optimized to minimize the scheduling demands as well as maximize the sampling frequency. Possible system optimizations could include: determining what rendering objects are present in the current job and only schedule for those types, exploiting correlations between different rendering types; i.e., two different screens may be correlated but offset from one another; and/or determining the minimum number of tone reproduction curve levels needed to interpolate the entire tone reproduction curve.

In summary, variable image rendering is realized by modulating the imager intensity on a pixel-by-pixel basis by utilizing image based tag information which includes information such as line screen type and text/line art. The tags essentially define possible rendering object types; e.g., halftone, text, etc. The tag information allows for a unique intensity "mapping" for each contone level and rendering object type. Using this information in combination with the contone information, image based tags are used in creating a variable intensity and generate a unique xerographic setup for each possible rendering type.

As noted above, unique intensity maps are created which provide independent rendering control over multiple tone reproduction curves and text/line art. In addition, using separate intensity settings for different input tone reproduction curve levels, the number of effective tone reproduction curve actuators is increased providing for more system latitude and increased flexibility in system integration. Moreover, cross-process non-uniformity can be compensated for by extending the tone reproduction curve mappings from one dimension (contone level only) to two dimensions (contone level and pixel position).

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system to control of the image quality in a digital imaging system, comprising:

an intensity control module to receive tag information data and image data, said tag information data providing information to identify an image content type;

a tone reproduction curve control module, operatively connected to said intensity control module, to provide set of laser intensity setting data to said intensity control module;

said intensity control module generating a laser intensity setting signal in response to said received tag information data, image data, and laser intensity setting data.

2. The system as claimed in claim 1, wherein said intensity control module comprises a plurality of lookup tables and a selection circuit, each lookup table corresponding to an image content type and associated laser intensity setting data, each lookup table producing a laser intensity setting signal corresponding to said received image data;

said selection circuit selecting a laser intensity setting signal in response to said received tag information data.

3. The system as claimed in claim 1, wherein said intensity control module comprises a plurality of lookup tables and a selection circuit, each lookup table corresponding to an image content type and associated laser intensity setting data;

said selection circuit enabling one of said lookup tables to output a laser intensity setting signal in response to said received tag information data.

4. The system as claimed in claim 1, wherein said intensity control module calculates a laser intensity setting signal in response to said received tag information data, image data, and set of laser intensity setting data.

5. The system as claimed in claim 1, wherein said intensity control module receives pixel positional information data;

said intensity control module generating a laser intensity setting signal in response to said received tag information data, pixel positional information data, image data, and set of laser intensity setting data.

6. The system as claimed in claim 1, wherein said tone reproduction curve control module includes a sensing system to measure an output of a reproduction engine;

said tone reproduction curve control module modifying the sets of laser intensity setting data being provided to said intensity control module in response to the measure output of a reproduction engine.

7. A system to control the image quality in a digital imaging system, comprising:

an intensity control module to receive tag information data and image data, said tag information data providing information to identify an image content type;

a halftoning module to receive tag information data and image data and to produce binary data therefrom;

a tone reproduction curve control module, operatively connected to said intensity control module, to provide set of laser intensity setting data to said intensity control module; and a laser controller, operatively connected to said halftoning module and said intensity control module, to provide control signals to a laser to control an intensity of the laser and an ON/OFF state of the laser;

said intensity control module generating a laser intensity setting signal in response to said received tag information data, image data, and laser intensity setting data.

8. The system as claimed in claim 7, wherein said intensity control module comprises a plurality of lookup tables and a selection circuit, each lookup table corresponding to an image content type and associated laser intensity setting data, each lookup table producing a laser intensity setting signal corresponding to said received image data;

said selection circuit selecting a laser intensity setting signal in response to said received tag information data.

9. The system as claimed in claim 7, wherein said intensity control module comprises a plurality of lookup tables and a selection circuit, each lookup table corresponding to an image content type and associated laser intensity setting data;

said selection circuit enabling one of said lookup tables to output a laser intensity setting signal in response to said received tag information data.

10. The system as claimed in claim 7, wherein said intensity control module receives pixel positional information data;

said intensity control module generating a laser intensity setting signal in response to said received tag information data, pixel positional information data, image data, and laser intensity setting data.

11. The system as claimed in claim 7, wherein said tone reproduction curve control module includes a sensing system to measure an output of a reproduction engine;

said tone reproduction curve control module modifying the sets of laser intensity setting data being provided to said intensity control module in response to the measure output of a reproduction engine.

12. A method to control of the image quality in a digital imaging system, comprising:

generating a control signal to control an ON/OFF state of the laser;

generating a set of laser intensity setting data; and generating a laser intensity setting signal in response to tag information data, image data, and the set of laser intensity setting data, the tag information data providing information identifying an image content type.

13. The method as claimed in claim 12, wherein the laser intensity setting signal is generated from a plurality of lookup tables having stored therein a plurality of laser intensity settings, each lookup table being indexed by the image data, the image content type selecting which lookup table is utilized to generate the laser intensity setting signal.

14. The method as claimed in claim 12, wherein the laser intensity setting signal is generated in response to image content type of a pixel of interest, position of the pixel of interest, and image data.

15. The method as claimed in claim 14, wherein the laser intensity setting signal is generated from a plurality of lookup tables having stored therein a plurality of laser intensity settings, each lookup table being indexed by the image data and the position of the pixel of interest, the image content type of the pixel of interest selecting which lookup table is utilized to generate the laser intensity setting signal.

16. The method as claimed in claim 13, further comprising:

measuring an output of a reproduction engine; and modifying the laser intensity settings stored in the plurality of lookup tables in response to the measure output of a reproduction engine.

* * * * *